United States Patent [19]

Carson, Jr. et al.

[11] 4,328,131

[45] May 4, 1982

[54] ELASTIC DETERGENT BAR OF IMPROVED ELEVATED TEMPERATURE STABILITY

[75] Inventors: John C. Carson, Jr., Manasquan Park; James H. Bowers, Somerville, both of N.J.

[73] Assignee: Colgate-Palmolive Company, New York, N.Y.

[21] Appl. No.: 746,871

[22] Filed: Dec. 2, 1976

[51] Int. Cl.[3] ..... C11D 1/18; C11D 1/38; C11D 17/00

[52] U.S. Cl. ..... 252/542; 252/89.1; 252/132; 252/134; 252/535; 252/545; 252/546; 252/550; 252/551

[58] Field of Search ..... 252/DIG. 16, 134, 535, 252/89 R, 132, 542, 545-546, 550, 551

[56] References Cited

U.S. PATENT DOCUMENTS

| | | | |
|---|---|---|---|
| 2,398,776 | 4/1946 | Bodman | 252/134 |
| 3,442,812 | 5/1969 | Barnhursh | 252/142 |
| 3,689,437 | 9/1972 | McLaughlin | 252/535 |
| 3,708,425 | 1/1973 | Compra | 252/DIG. 16 |
| 4,181,632 | 1/1980 | Schebece | 252/542 |

FOREIGN PATENT DOCUMENTS

| | | | |
|---|---|---|---|
| 731396 | 6/1955 | United Kingdom | 252/DIG. 16 |
| 1194861 | 6/1970 | United Kingdom | 252/DIG. 16 |

*Primary Examiner*—George F. Lesmes
*Assistant Examiner*—E. Rollins Buffalow
*Attorney, Agent, or Firm*—Herbert S. Sylvester; Murray M. Grill; Raymond F. Kramer

[57] ABSTRACT

An elastic detergent bar of improved elevated temperature stability, so that it better maintains its shape on storage at temperatures somewhat higher than normal, includes an amphoteric synthetic organic detergent in mixture with an anionic synthetic organic detergent, gelatin, water and insoluble gas in very small bubble form distributed throughout the bar. The bars are substantially form-retaining during storage and although they wear away during use, substantially retain their initial forms and elasticities for major proportions of their useful lives. Compared to similar bars in which the insoluble gas, such as air, is not present, the invented bars are stable at higher storage temperatures, e.g., 5° to 10° C. higher, making them commercially much more acceptable. Additionally, the elastic detergent bars are resistant to breakage during shipment and use, exhibit less surface tackiness than similar control bars, are very easily molded to finely figured and detailed shapes and of course, because of their lower density, float. Also within the invention is a process for making the described products.

19 Claims, No Drawings

ELASTIC DETERGENT BAR OF IMPROVED ELEVATED TEMPERATURE STABILITY

This invention relates to elastic detergent bars. More particularly, it relates to detergent bars intended for conventional toilet soap uses, either as hand "soaps" or bath or shower "soaps", which are elastic in nature, which include amphoteric synthetic organic detergent, gelatin and water and which have an insoluble gas dispersed in them. Surprisingly, the presence of the gas significantly increases the elevated temperature storage stability of such bars, making them much more commercially acceptable than control bars in which the gas bubbles are not present. The elastic detergent bars of this invention are excellent foaming detergent products, generating foam when alternately squeezed and released in the bath water. Their "squeezability" makes them a useful plaything, increasing children's pleasure in taking a bath.

A wide variety of materials has been incorporated into soap and synthetic detergent compositions. Soap bars have included perfumes, colorants, abrasives, bleaches, fillers, emollients and bodying agents and among the bodying agents gelatin is one that has been utilized in the past. Soap bars have usually contained a lower polyhydric alcohol, such as glycerol and additionally, water, both of which are produced and utilized in the soapmaking process. Of course, floating soaps, the density of which has been decreased by aeration, has been marketed for many years.

In U.S. Pat. No. 2,360,920 there are disclosed soap buds made from an aerated aqueous solution of soap containing glycerin and a demulcent, such as may be made from a mixture of Irish moss and gelatin. U.S. Pat. No. 3,689,437 teaches the manufacture of malleable and non-hardenable detergent products from certain percentages of a fatty acid isethionate, water, gelatin and hydrocarbon, with a filler being optionally present. The resulting bars, which may also contain glycerol or propylene glycol and other adjuvants, are said to be moldable and extrudable but not elastic (apparently the elasticity is destroyed upon incorporation of the isethionate into the composition). British patent 731,396 describes the manufacture of a shaped organic soapless detergent composition in which the organic soapless detergent, such as triethanolamine alkylbenene sulfonate, is dispersed in a gelatin gel. Aeration of the gel to produce a frothy product is suggested, as are the additions of various builders, fillers, nonionic detergents, etc.

In copending U.S. patent application Ser. No. 746,999, entitled Elastic Detergent Bar filed Dec. 2, 1976 by Frank Schebece, now U.S. Pat. No. 4,181,632 improved synthetic organic detergent bars based on synthetic anionic detergent and cross-linked or denatured gelatin are described, as are detergent bars based on amphoteric detergents, with or without such cross-linking and/or denaturing agent(s). In copending U.S. patent application Ser. No. 746,995, entitled Elastic Detergent Bar Containing Anionic and Amphoteric Synthetic Organic Detergents filed Dec. 2, 1976 by Frank Schebece and John C. Carson, Jr., improved elastic detergent bars which include mixtures of synthetic organic anionic and amphoteric detergents are described. The disclosures of both these applications are hereby incorporated herein by reference.

Although the prior art has recognized that gelatin may be included in detergent compositions which may be desirably molded or shaped into bar or cake form and although the patent applications mentioned teach the employment of amphoteric synthetic organic detergents, alone or in mixture with anionic synthetic organic detergents, and gelatin to make an elastic detergent bar the art does not describe or suggest bars of the present invention wherein in a composition comprising amphoteric synthetic organic detergent and gelatin, small air bubbles are distributed to improve the elevated temperature stability of the product and make it commercially more acceptable.

In accordance with the present invention an elastic detergent bar of improved elevated temperature stability in storage comprises about 20 to 80% of a mixture of anionic and amphoteric synthetic organic detergents in a proportion between about 1:5 and 5:1, about 5 to 30% of gelatin, about 5 to 50% of water and sufficient gas in small bubbles distributed throughout such bar so that the density of the bar is in the range of 0.5 to 0.98 g./cc. In preferred formulations the anionic detergent is a higher fatty monoglyceride sulfate, usually as the alkali metal or ammonium salt, or a triethanolammonium higher fatty alcohol sulfate or a mixture thereof and the amphoteric detergent is an imidazolinium betaine, a betaiminodipropionate or a betaaminopropionate or mixture thereof. Although the preferred products include mixtures of anionic and amphoteric detergents, gelatin and water, often with a lower dihydric or polyhydric alcohol, aerated to produce a bar which is lighter than water, in its broadest aspect the present novel invention is of an elastic detergent bar based on an amphoteric detergent and gelatin which has been aerated or gasified. In process embodiments of the invention, after dissolving of the gelatin and other components in an aqueous medium at an elevated temperature the temperature is lowered, while still being kept above room temperature, air or other gas is mixed into the detergent bar composition and the mix, while still mobile and with the air bubbles distributed through it, is cooled to solidify it and to entrap the air bubbles therein. To obtain a further increased elevated temperature stability the mix may be heated and/or subjected to vacuum treatment before mixing in of the gas so as to decrease the moisture content.

The anionic synthetic organic detergents of this invention include sulfated, sulfonated and phosphonated hydrophobic moieties, especially those which include higher hydrocarbyl groups (preferably fatty), such as alkyl groups of 8 to 20 carbon atoms, preferably of 10 to 18 carbon atoms. These compounds are usually employed as their water soluble salts, such as salts of alkali metals, e.g., sodium, potassium and triethanolamine and ammonia. For the present compositions these salts will usually be either sodium, ammonium, potassium or triethanolamine salts and of these the triethanolamine (or triethanolammonium) salts will often be preferred. Among the various types of synthetic anionic organic detergents which may be useful are the linear higher alkylbenzene sulfonates, especially those of 12 to 15 carbon atoms, e.g., sodium linear tridecylbenzene sulfonate; paraffin sulfonates; olefin sulfonates; higher fatty alcohol sulfates; monoglyceride sulfates, especially the sulfated monoglycerides of coconut oil, tallow, hydrogenated coconut oil, hydrogenated tallow and synthetic higher fatty acids of 8 to 20 carbon atoms, e.g., sodium coconut oil monoglyceride sulfate, ammonium cocomonoglyceride sulfate; corresponding sulfates and phosphonates and other equivalent organic sulfonates, in most of which the lipophilic group includes a chain of 10 to 18 carbon atoms. In the above description and elsewhere in the specification and in the claims when a material is characterized as a "monoglyceride sulfate" such terminology is intended to describe higher fatty acid monoglyceride sulfates wherein the higher fatty acid is of 8 to 20 carbon atoms, preferably of 10 or 12 to 18 carbon atoms, such as lauric acid, myristic acid, palmitic acid, stearic acid and oleic acid. Additionally useful are the sulfates and sulfonates of nonionic detergents and of nonionic surface active agents, in which products the nonionic base will normally be a polyethylene oxide condensation product of a higher fatty alcohol, such as a condensation product based on a higher fatty alcohol of 10 to 18 carbon atoms, wherein the ethylene oxide content is from 3 to 30, preferably 5 to 10 or 12 mols of ethylene oxide per mol of higher fatty alcohol. A specifically preferred anionic detergent is ammonium monoglyceride sulfate of 8 to 18 or 20 carbon atoms in the fatty acid group, e.g., ammonium cocomonoglyceride sulfate (coco includes derivation of the fatty acids from coconut oils), although alkali metal monoglyceride sulfates, such as sodium monoglyceride sulfate, are also useful. While sodium lauryl sulfate is an anionic synthetic organic detergent which may be employed, preferably in minor proportion with other anionic synthetic organic detergents in the present compositions, its use is usually not preferable and the corresponding triethanolammonium salt is normally used instead because it can produce a transparent or translucent bar of good washing and foaming ability which is also stable on storage and maintains its elasticity during use. The ammonium and trilower alkanolammonium salts of other anionic detergents also aid in making a clear product rather than a cloudy one, which often results when metal salts, such as alkali metal salts, are used, and it is usually considered to be desirable for the present detergent articles to be clear.

The amphoteric detergents which may be utilized to manufacture the elastic detergent bars of this invention include such compounds as Deriphat® 151, which is sodium N-coco-betaaminopropionate (manufactured by General Mills, Inc.), Deriphat 160, a partial sodium salt of N-lauryl-betaiminodipropionate and other betaaminopropionates and betaiminodipropionates, such as sodium N-lauryl betaiminodipropionate, Miranol® C2M (anhydrous acid form, 1-carboxymethyl-1-carboxyethoxyethyl-2-coco-imidazolinium betaine), the water soluble salts thereof, especially the triethanolammonium salt, and other imidazolinium betaines, and other of the various known amphoterics, described in McCutcheon's *Detergents and Emulsifiers,* 1973 Annual and in *Surface Active Agents,* Vol. II, by Schwartz, Perry and Berch (Interscience Publishers, 1958), the descriptions of which are incorporated herein by reference. For example, Deriphats 151C, 154, 160-C and 170-C, and Miranols C2M, S2M and SHD Conc. may be employed. Additionally, even liquid amphoteric detergents may be used, at least in part, e.g., up to 25 to 50% of the total amphoteric detergent content. The recited references also contain extensive descriptions of various suitable anionic detergents and of nonionic and cationic detergents which may be employed in small proportion(s) in the present compositions. The various long chain substituents in the mentioned amphoterics are of 8 to 20 carbon atoms, preferably of 10 to 18 carbon atoms and most preferably are lauryl and coco.

The nonionic detergents, while not required components of the invented products, may be present in relatively small proportions therein in replacement of some of the anionic or amphoteric detergents. The nonionics are preferably solid or semi-solid at room temperature, more preferably solid, and include but are not limited to ethoxylated aliphatic alcohols having straight or branched chains (preferably straight chain) of from about 8 to 20 carbon atoms, with about 3 to about 30 ethylene oxide units per molecule. Particularly suitable nonionic detergents of such type are manufactured by Shell Chemical Company and are marketed under the trademark Neodol®. Of the various Neodols available, Neodol 25-7 (12–15 carbon atoms chain higher fatty alcohol condensed with an average of 7 ethylene oxide units per mol) and Neodol 45-11 (14–15 carbon atoms chain higher fatty alcohol condensed with an average of 11 ethylene oxide units per mol) are particularly preferred. Another suitable class of ethoxylated aliphatic alcohol detergents is made by Continental Oil Company and is sold under the trademark Alfonic®. Of the Alfonics the most preferred is Alfonic 1618-65, which is a mixture of 16 to 18 carbon atoms primary alcohols ethoxylated so as to contain 65 mol percent of ethylene oxide. Additional examples of nonionic synthetic organic detergents include those marketed by BASF Wyandotte under the trademark Pluronic®. Such compounds are made by condensation of ethylene oxide with a hydrophobic base formed by condensing propylene oxide with propylene glycol. The hydrophobic portion of the molecule has a molecular weight of from about 1,500 to 1,800 and the addition of polyoxyethylene (or ethylene oxide) to such portion increases the water solubility of the molecule as a whole, with the detergent being a solid at room temperature when the polyoxyethylene content is above 50% of the total weight of the condensation product. Such a nonionic detergent is Pluronic F-128 but F-68 may also be employed. Also useful nonionic detergents are the polyethylene oxide condensates of alkyl phenols, such as the condensation products of such compounds wherein the alkyl group contains about 6 to 12 carbon atoms, in either a straight chain or branched chain configuration, with 5 to 25 mols of ethylene oxide per mol of alkyl phenol. The alkyl substituents in such compounds may be derived from polymerized propylene or may be diisobutylene, octene or nonene, for example.

Representative cationic detergents, which usually also possess antibacterial (and fabric softening) properties, include di-higher alkyl di-lower alkyl ammonium halides such as distearyl dimethyl ammonium chloride, and 2-heptadecyl-1-methyl-1-[(2-stearoylamido)ethyl]-imidazolinium methyl sulfate. The higher alkyls thereof are of 8 to 20 carbon atoms, preferably 12 to 18 and the lower alkyls are of 1 to 4 carbon atoms, preferably 1 and 2. Such materials are normally omitted from compositions which also contain anionic detergents in significant proportions but may be employed in small proportions in amphoteric detergent bars or the present anionic-amphoteric bars, especially when such contain more amphoteric detergent than anionic detergent and when the proportion of anionic detergent therein is relatively small, e.g., less than ½ the content of amphoteric detergent.

Gelatin, a complex mixture of collagen degradation products of molecular weight in the range of about 30,000 to 80,000 and higher, depending on the hydrolytic conditions to which it has been subjected, is a vital constituent of the present compositions. Apparently because of its outstanding ability to form reversible gels, its high viscosity and the excellent strengths of films thereof, it helps to make a detergent bar which is of satisfactory strength and cleaning power, due to gradual dissolution of the ordinarily extremely soluble synthetic organic detergent component, and yet, which does not produce objectionable and unacceptable soft gels at bar surfaces which have been moistened. Additionally, and a major advantage of the present invention, the combination of gelatin and synthetic organic detergents, in the presence of water and preferably also in the presence of a lower dihydric or polyhydric alcohol or other suitable plasticizer, and often too, a cross-linking agent or denaturant, yields elastic products. The elastic detergent bars made are sufficiently elastic so that a bar 2 cm. thick can be wetted and pressed between thumb and forefinger to a 1 cm. thickness and will immediately (within five seconds) return to the 2 cm. thickness or at least to within 1 mm. thereof, upon release of pressure.

The gelatin employed is essentially colorless and free from odor. It is amphoteric (about 45 milliequivalents of amino functions and about 70 milliequivalents of carboxyl functions per hundred grams thereof). It is normally used in formulating as a dry granular product which is crystalline in appearance although it is really amorphous. It is insoluble in cold water but swells rapidly in the presence of water until it has imbibed about 6 to 8 times its weight thereof and it melts to a viscous solution in water when warmed to above 40° to 45° C. Gelatins are classified as either type A or type B, the former being from acid-cured stock, with an isoelectric point of about 8.3–8.5 and the latter being of alkali-cured stock, with an isoelectric point of about 4.8–5.0. Type A gelatins are preferred for the present applications but type B gelatins may also be used, as may be mixtures of the two. The gelling powers of gelatins are normally measured by the Bloom test. Often too, viscosity will also be employed to characterize a gelatin and a gel strength: viscosity ratio may be specified, e.g., 3:1 to 5:1. Gel strengths will range from 100 to 300 g. Bloom but will usually be in the range of 150 or 200 to 300, with gelatins of Bloom values of 225 g. and 300 g. being employed in the examples herein. The type A gelatins will generally be utilized with the usual detergent bar constituents, normally intended for employment in neutral or slightly basic aqueous media, and the type B gelatins will be preferred when acidic conditions are expected to be encountered.

Cross-linking agents for gelatin and for other proteins are metal salts which cross-link various gelatin molecules, apparently by reacting with free carboxyl functions thereof. This class of compounds is well known and the salts employed are usually those of aluminum, calcium, magnesium and/or zinc that are soluble in aqueous media. In such salts the preferred anions are chloride, bromide, iodide, sulfate, bisulfate and acetate but other suitable anions may also be included. Examples of such salts include potassium aluminum sulfate hydrate [alum, $KAl(SO_4)_2.12\ H_2O$], aluminum chloride, other alums, calcium chloride, magnesium sulfate and zinc acetate. Also useful for cross-linking is formaldehyde, usually as formalin. About 0.1 to 1% of formaldehyde, preferably 0.1 to 0.3%, is normally adequate. Although the presence of a cross-linking agent is often highly desirable in the formulations of the invented bar compositions, especially those based on anionic detergents primarily, it has been found that such are not as important or useful in those compositions based primarily on amphoteric detergents.

Instead of or in addition to a cross-linking agent a denaturant may be employed with the gelatin of the present composition. Such a compound also helps to reduce solubility of gelatin at and near its isoelectric point and inhibits crystallization. Although denaturation may be effected by various materials, including various detergents, ethanol, acetone, strong acids and strong alkalis, chemical denaturation, usually by urea, dextrose or guanidine hydrochloride, is preferred and of these compounds the first is much preferred. Both cross-linking and denaturation and the combination thereof are helpful in producing a lastingly elastic detergent bar of desired properties, suitable for repeated and satisfactory cleaning applications, but neither cross-linking agents nor denaturants for gelatins are required to make a satisfactory elastic detergent bar of the present invention.

The lower dihydric and/or polyhydric alcohol component(s) of the present bars functions as a mutual solvent and plasticizer for the bar components, especially the gelatin. It facilitates solubilization of the detergent at a desired rate and maintains the surface of the bar soft. If the bar became objectionably hard at portions thereof this could be cause for rejection of it by consumers. Such alcohol also helps to distribute the various components evenly throughout the bar or cake. Although a variety of lower dihydric or polyhydric alcohols may be employed, including various sugars and sugar alcohols, having up to 6 carbon atoms and up to 6 hydroxyls per molecule, the most preferred are those of 2 to 3 carbon atoms and 2 to 3 hydroxyl groups per molecule. Such compounds include propylene glycol (1,2-dihydroxypropane or 1,2-propylene glycol), trimethylene glycol (1,3-propylene glycol) and glycerol, of which 1,2-propylene glycol, glycerol and mixtures thereof are preferred. Other useful solvents are the Cellosolves®, the mono- and di-lower alkyl ethers of ethylene glycol. Additionally, sometimes monohydric alcohols, such as ethanol are useful, primarily as supplementary solvents.

The water employed is preferably deionized water which will normally contain less than 10 parts and preferably less than 1 part per million of hardness, as calcium carbonate, but normal city waters may also be utilized, such as those having hardnesses in the range of 10, 20 or 50 to 150 or 300 p.p.m., as $CaCO_3$.

The insoluble gas distributed throughout the detergent bar in finely divided bubbles is preferably air but may be any other gas which is substantially insoluble in the detergent bar mixture, especially when such mix is in a fluid state and at an elevated temperature. Thus, nitrogen, argon and other noble gases may be employed. Although carbon dioxide is somewhat soluble, under the conditions of mixing and solidification it is sufficiently insoluble as to be useful. The gas will usually be in microscopic bubble form, with diameters usually between 1 micron and 1 mm., preferably between about 10 microns and 0.1 mm., and the bubbles are preferably substantially homogenously distributed through the bars.

Additional desirable components of the present compositions are lower alkylene glycol di-higher fatty acid esters. The lower alkylene glycol is normally ethylene or propylene glycol and the higher fatty acid is one of 8 to 20 carbon atoms, preferably 10 to 18 carbon atoms, e.g., lauric acid, stearic acid. Compounds of this type have been found to minimize surface tackiness of the present bars and this desirable result is noted with non-aerated bars and those which are aerated or gasified. A most preferred example of the lower alkylene glycol di-higher fatty acid esters is ethylene glycol distearate.

With the basic elastic detergent bar composition there may be present various adjuvant materials in minor proportions to contribute their particular properties to the final product. Among such adjuvant materials are functional and aesthetic adjuvants, such as: perfumes; pigments; dyes; optical brighteners; skin protecting and conditioning agents, e.g., lanolin, solubilized lanolins; chemical stabilizers, e.g., sodium bisulfite; foam stabilizers, e.g., lauric myristic diethanolamide; buffering agents and pH adjusters, e.g., triethanolamine, hydrochloric acid, phosphates; bodying agents, e.g., clays, fumed silicas; superfatting agents, e.g., stearic acid; anti-redeposition agents and soil dispersants, e.g., polyvinyl alcohol, sodium carboxymethyl cellulose; gums, e.g., sodium alginate, which also functions as a slip improving agent; and abrasive or scouring components, e.g., silex. Usually the present bars do not and should not contain any fillers or builder salts other than those which may accompany, usually unavoidably, other components of the product. However, in certain circumstances, as when bars for heavy duty laundry use are made, it may be desirable to add fillers, such as sodium sulfate and sodium chloride and builder salts, such as pentasodium tripolyphosphate, sodium carbonate and sodium silicate. Particularly desirable adjuvants in the present compositions are mixed phosphates to serve as a buffer system and also to improve non-tackiness of the product, and fumed silica bodying agent, which also helps to diminish surface tackiness effects. A preferred mixture of phosphates is of mono-alkali metal phosphate and di-alkali metal phosphate, e.g., monosodium phosphate and disodium phosphate, in a ratio within the range of 1:5 to 5:1, preferably 1:4 to 1:2. The fumed silica component may be a commercial fumed silica, such as Cab-O-Sil® M-5, wherein the fumed silica particles are of colloidal sizes, such as in the 0.1 to 2 micron diameter range. Other pyrogenic colloidal silicas may also be utilized such as the Cab-O-Sils designated L-5 and SD-20 and comparable competitive compounds, all of which have high surface areas per unit weight, such usually being in the range of about 50 to 400 square meters per gram.

The proportions of the various components of the present elastic detergent bar should be kept within ranges to be given to obtain the best results and to produce a bar which will be desirably elastic and useful in replacement of conventional soap, soap-detergent and detergent bars and which possesses improved properties, such as a lesser tendency to slough when in contact with water, compared to similar detergent-based bars, a lesser tendency to shrink on storage, a greater stability at elevated storage temperatures and improved surface (non-tacky) properties.

The synthetic organic detergent component, the mixture of anionic and amphoteric detergents, will be about 20 to 80% of the product, preferably 30 to 70% thereof and more preferably 40 to 60%. The gelatin, preferably type A gelatin of 225 to 300 g. Bloom, will be about 5 to 30%, preferably 7 to 25% and more preferably 10 to 20% of the finished bar or cake. The moisture content will be about 5 to 50%, preferably 5 to 40% and more preferably about 10 to 30%. Lower dihydric or polyhydric alcohol or mixture thereof, which may be omitted if objectionable syneresis or softness problems are encountered (usually due to a high percentage of normally liquid components in the product), will usually be present in the range of 3 to 20%, preferably 5 to 15%, e.g., 10%.

The lower alkylene glycol di-higher fatty acid ester anti-tack component will often comprise 0.2 to 5%, preferably 0.2 to 2%, and more preferably 0.3 to 1%, e.g., 0.5% or 0.6% of the finished bar. When a cross-linking agent and/or a denaturing agent is present the proportion thereof will usually be about 0.1 to 5%, preferably 0.7 to 2%. The proportion of fumed silica or similar bodying agent will generally be in the range of 1 to 5%, preferably 2 to 4% and the proportion of phosphate buffering agent (also possessing some building properties) will usually be from 0.5 to 4%, preferably 0.7 to 2%. The total proportion of any other adjuvants present, including any builders and fillers, will normally not exceed 10%, preferably will be less than 5% and more preferably will be less than 2%, with the proportion of any particular adjuvant usually being less than 5%, preferably less than 2% and more preferably less than 1%.

Mixtures of various materials within the classifications mentioned above may be employed in place of single pure materials and it is contemplated that technical chemicals, containing relatively small percentages of impurities, will be utilized, as well as those which are chemically pure. Within the percentage and proportion ranges given satisfactory elastic detergent bars of improved elevated temperature storage stability are obtained and with the present specification as a guide, one of skill in the art will be able to adjust the various percentages and proportions within the ranges given so as to produce the most satisfactory products. However, when percentages and proportions outside the ranges and ratios recited are utilized less desirable detergent bars will result, often being excessively firm or soft, inelastic (often being malleable instead), tacky, poorly foaming, subject to excessive shrinking and syneresis or weeping, or otherwise being unacceptable commercially. Such bars, which are outside the present invention, will not be as stable under elevated temperature storage conditions. On the contrary, the bars of this invention are satisfactorily elastic, do not shrink or weep excessively, are neither unduly soft nor too firm, are of improved elevated temperature storage stability and are useful and attractive detergents.

The manufacture of the invented elastic detergent bars is comparatively simple and requires only the mixing together of the various components under such conditions that the gelatin will form a satisfactory gel with water and/or with any other components present. For example, all the components of a particular detergent bar composition may be mixed together and heated, with stirring, to dissolve the gelatin or the gelatin may be first dissolved in water and the other components may then be admixed with the solution. Similarly, other operative mixing sequences may be adopted. The temperature to which the medium may be heated to assist in dissolving the gelatin will be above the normal 40 or 45° C. melting or dissolving point of gelatin, usually being from 50° to 90° or 95° C. and preferably from 60° to 80° C. After the gelatin and all other soluble components of the bar composition are dissolved, which will usually take from 3 to 30 minutes, additional heating may be employed, with or without the application of vacuum, to remove water and any other volatile solvent material so as to increase the firmness of the product and improve its characteristics. Normally the additional period of heating will be at a temperature in one of the ranges previously given for dissolving the gelatin and other components and will take from one minute to one hour, preferably one minute to thrity minutes and more preferably, five minutes to fifteen minutes, e.g., ten minutes. The vacuum utilized will normally be in the range of 25 to 250 mm. Hg. absolute, if employed. During the evaporation process from 5 to 50% (of the weight of the mixture) of water is driven off, preferably 5 to 25% thereof, so that the final product will usually have a moisture content of about 10 to 25 or 30%.

After dissolving of the bar components and after optional evaporation off of some of the moisture content of the mix the temperature will usually be lowered to about 30 to 45° C. and gas, preferably air, will be mixed with the gel to form finely divided bubbles therein, as previously described. Such mixing may be mechanical, as with known "Lightnin" or "Eppenbach" homogenizing mixers, which blend ambient air with the gel, or diffusers, injectors, distributors, aerators or other means may be used to incorporate gas with the gel, preferably in conjunction with sufficiently vigorous mixing to create enough turbulence in the mixture to promote blending in with it of the finely divided gas bubbles. Normally the homogeneous addition of gas bubbles will increase the volume of the mix from about 5 to 60%, preferably 10 to 50%, so that the bar made will have a density lower than that of water, usually being in the range of about 0.5 to 0.98 g./cc., preferably 0.65 to 0.9 g./cc., e.g., 0.8 g./cc. The gasified mixture is then poured into suitable cooled molds which are usually at a temperature of 5° to 20° C., preferably 5° to 15° C., in which it is cooled to a temperature of about 5° or 10° to 25° C. or 30° C., preferably 5° to 20° C., preferably 5° to 15° C. After the gelatin composition has completely set, which may take from about one minute to an hour, usually taking from three to ten minutes, the elastic detergent bar or cake may be removed from the mold and packed or it may be allowed to be warmed to room temperature before packing at which temperature it still remains firm, yet elastic.

The elastic detergent bars of this invention possess and important novelty advantage over ordinary soap or detergent bars. They are especially attractive to children when they are molded into special shapes, such as the shapes of storybook, fairy tale or cartoon characters, people or animals and promote the enjoyment of bathing by infants and yound children. The elastic nature of the product allows a controlled dispensing of detergent and other foaming materials onto the skin or into the bath water in response to repeated squeezings and relaxings of the bar. Thus, the utilitarian detergent is also a delightful toy. However, the product has various other advantages apart from its play value. The presence of gelatin adds a skin care ingredient to the composition and because of the bar's elasticity breakage in shipment or during storage is minimized. Furthermore, large quantities of synthetic organic detergent may be present in the composition without the need for extensive uses of waxes, plasticizers, bodying agents, etc., to control the dissolving thereof and to give them desirable tactile properties and good appearances. The bars do not slough excessively, as often do detergent and soap bars and additionally, they maintain substantially their original shapes during use, continually dispensing detergent in response to compressions and relaxations and rubbing against areas to be cleansed. They have a different "feel" than soap when contacting the skin and this better contact assists in cleaning. The detergents in the bars or other shaped articles are readily released at temperatures of 25° to 40° C. and higher and for cold water washing, at temperatures of 10° C. and less, more soluble and lower Bloom value gelatins can be employed, with appropriate solvents and adjuvants, to help release the detergent.

Although bars which are normally transparent, without dispersed gas bubbles therein, may be made translucent or opaque due to the presence of the bubbles, oftentimes this is desirable and insoluble materials such as the pyrogenic silicas may be intentionally incorporated for their opacifying effects, in addition to their bodying and detackifying properties. The presence of a lower alkylene glycol di-higher fatty acid ester helps to improve the bar surface properties and to make it less tacky too, as does a small proportion of mixed phosphates. When made by the preferred process wherein the percentage of moisture in the final product is diminished, usually being limited to 30 to 40%, any tendency of the bar to shrink on storage is diminished and a firmer product is obtained. Finally, the incorporation of the gas bubbles in the bar, in addition to making a floating product, which is usually desirable, has the unexpectedly and significantly beneficial effect of raising the upper limit on the storage temperature to which the bar may be subjected without being deformed. Such limit may be increased to as high as 43° or 45° C. or more in some cases compared to 35° or 38° C. or less without gasification, despite the fact that gelatin tends to melt at temperatures above 40° to 45° C. The elevated temperature stability increase is often of critical importance with respect to commercial marketing of detergent products because they will be warehoused, shipped or subjected to other operations in which temperatures approaching such 43° or 45° C. limits will at least sometimes be encountered and if they are not form-stable at such temperatures the products will distort and will become unmarketable.

It is to be understood that within the proportions of components given variations may be made to best promote desired properties of the bars manufactured and similarly, processing modifications may also be effected. Thus, proportions of gelatin, detergent, water, cross-linking agent, denaturant, plasticizer, pyrogenic silica, glycol diester, phosphates and other adjuvants may be adjusted, as may be the types of such materials. For example, if the bar is too soft an increase in the solids content, especially in the gelatin content, may be desirable and the gelatin type may be changed to that of higher Bloom value to increase the firmness of the product. Also, in such case it may be desirable to utilize more cross-linking agent and/or denaturant. If the bar is too firm, reverse adjustments may be made. Those of skill in the art, with this specification before them, will be able to modify the properties of the described compositions and make them conform to desirable product standards and similarly will be able to modify the processes described.

The following examples illustrate but do not limit the invention. Unless otherwise indicated all temperatures are in °C. and all parts are by weight.

EXAMPLE 1

| | Percent |
|---|---|
| 1-carboxymethyl-1-carboxyethoxyethyl-2-coco-iminodazolinium betaine | 21.0 |
| Triethanolamine | 7.5 |
| Propylene glycol | 10.0 |
| Triethanolammonium lauryl sulfate (40% active ingredient aqueous solution) | 47.0 |
| Fumed silica (Cab-O-Sil M-5) | 3.0 |
| Gelatin (300 g. Bloom, Type A) | 10.0 |
| Ethylene glycol distearate | 0.5 |
| Monosodium phosphate | 0.3 |
| Disodium phosphate | 0.7 |

The components of the above formula are mixed together in a mixing tank equipped with a Lightnin® homogenizing mixer and the speed of the mixer is adjusted to be slow enough so as not to entrain objectionable proportions of air in the mix. The temperature is raised to about 75° C. and mixing is effected for about 15 minutes, during which time the gelatin and other soluble materials dissolve and a homogenous mixture is produced. During that period the triethanolamine reacts with the Miranol C2M to form the corresponding triethanolamine salt thereof or its ionized equivalent. After production of the homogeneous mixture the temperature thereof is lowered (heating and cooling coils are present in the mixing tank) to about 40° C., at which temperature the homogenizing mixer speed is increased sufficiently so as to entrain air in the mix. Mixing is continued for an additional five minutes, during which time the volume of the mix in the water increases about 30%, so as to fill the mixer to within 10% of its volume. The mix is then poured into cooled molds which are at a temperature of 10° C. and in them is lowered to a temperature of about 15° C., at which it is solidified, with the air bubbles entrapped therein. Such bubbles are of diameters in the range of one micron to 1 mm. and the density of the molded elastic detergent bar produced is about 0.8 g./cc. The bar moisture content is about 28.5%.

The product made is a useful elastic detergent bar of acceptable surface characteristics (smooth and non-tacky), good detergency and improved elevated temperature storage characteristics. It floats in water (having a density of about 0.8 g./cc.) and during use does not slough objectionably. When wrapped and stored in cases at a temperature of 43.5° C. for a month no distortion of the molded bar due to softening or melting is noted. The combination of elasticity and porosity due to the molded-in air content, homogeneously distributed throughout the bar in the form of minute bubbles, aids in developing foam from the bar when it is repeatedly compressed and released and/or rubbed against the skin. Also, the bar resists breakage during storage, transportation and use and substantially retains its original molded form during use.

When modifications are made in the manufacturing procedure in accordance with the previous description similarly satisfactory bar products result. Thus, when instead of a Lightnin mixer, an Eppenbach homogenizing mixer is used, a substantially identical product results. When the amphoteric betaine detergent is charged as its triethanolamine salt and any excess triethanolamine of the formula is charged as such the bars produced are also satisfactory. Elimination of the phosphates, ethylene glycol distearate, fumed silica and even of the propylene glycol from the formula still results in the production of a useful elastic detergent bar, which is also made by the same method when only the amphoteric detergent, gelatin and a suitable medium for gelation are present, together with the entrapped gas bubbles. Replacing the amphoteric betaine with other amphoteric detergents, such as those described in the previous specification, e.g., Deriphat 151, Deriphat 160 and 50:50 mixtures thereof, also results in satisfactory products as does replacement of the triethanolamine (or triethanolammonium) lauryl sulfate with ammonium cocomonoglyceride sulfate and other of the anionic detergents mentioned in the specification. Instead of the 10% of 300 g. Bloom type A gelatin there may be employed 14% of 225 g. Bloom type A gelatin or similar quantities of corresponding type B gelatins and useful products result, although the type A and higher Bloom rating gelatins make more stable and firmer products. Of course, when potash alum or urea or other cross-linking or denaturing agents are present to the extent of 1.5 and 1% respectively, or in mixture, in replacement of some of the water in the formulation, firmer bar products result. Replacement of the dispersed air with other insoluble gases, such as argon, nitrogen and carbon dioxide, also produces useful products but because of the solubility of the carbon dioxide in water, especially during use of the bar, it is less preferred. Spargers or other bubble generators may be employed to disperse the gases into the mixtures.

In another variation of the process described, after the mixing together of the bar components in the Lightnin homogenizing mixer and before cooling the mix and blending gas with it, the mix is heated so as to maintain it at a temperature of 70° C. for an additional ten minutes at a vacuum of 200 mm. Hg. absolute to evaporate off enough moisture, about 10% of the weight of the mix, so as to make the final bar moisture about 20.6%. A firmer bar results, which shrinks less on storage.

Further variations are made in the formulas of Example 1 by varying the proportions of the described components ±10 and ±25%, while still keeping them within the ranges previously given in the specification. Useful elastic detergent bar products of the qualities previously mentioned result.

EXAMPLE 2

| | Percent |
|---|---|
| Miranol C2M (anhydrous acid) | 21 |
| Triethanolamine | 7.5 |
| Propylene glycol | 10.0 |
| Triethanolammonium lauryl sulfate (40% active ingredient aqueous solution) | 23.5 |
| Cab-O-Sil M-5 | 3.0 |
| Gelatin (300 g. Bloom, Type A) | 10.0 |
| Ethylene glycol distearate | 0.5 |
| Monosodium phosphate | 0.3 |
| Disodium phosphate | 0.7 |
| Ammonium cocomonoglyceride sulfate (47% active ingredient aqueous solution) | 23.5 |

The above formula is mixed together and the components thereof are processed by the method described in Example 1, without evaporation of moisture. When poured into molds and solidified the elastic detergent bars resulting are of the same general desirable properties mentioned for the products of Example 1. Similarly, when the moisture content of the final bar, about 27%, is decreased to 18.9% by evaporation of about 10% of the weight of the mix before distributing air bubbles throughout it, as described in Example 1, the product resulting is firmer and has the other useful properties of such lower moisture content bars.

When the proportions of components are varied in the same manner as described in Example 1 but are kept within the ranges specified, useful and satisfactory elastic detergent bars are produced. Also, when half of the Miranol C2M is replaced with Deriphat 160 (it may be incorporated in the formula as an aqueous solution, Deriphat 160-C, but added moisture will be removed by evaporation during mixing) a product of essentially the same characteristics as that of the formula of this example is made. This is also the result when glycerol or a mixture of glycerol and propylene glycol (1:1) is employed in replacement of the propylene glycol.

In addition to the basic formulas shown in the previous examples there may be present small proportions of various common adjuvants, such as 0.5% of perfume, 0.5% of sodium alginate and/or sodium carboxymethyl cellulose, 0.1% of dye, 0.3% of pigment, 1% of stearic acid, as an emollient and 0.5% of suitable germicide, to contribute their particular properties to the bar. Usually such materials will replace portions of the moisture content of the formulation.

EXAMPLE 3

| | Percent |
|---|---|
| Triethanolamine salt of Miranol C2M, anhydrous acid | 28 |
| Triethanolamine | 0.5 |
| Triethanolammonium lauryl sulfate (40% active ingredient, aqueous solution) | 55 |
| Pyrogenic silica (Cab-O-Sil M-5) | 3.0 |
| Gelatin (225 g. Bloom, Type A) | 10 |
| Ethylene glycol distearate | 0.5 |
| Monosodium phosphate | 0.3 |
| Disodium phosphate | 0.7 |
| Deionized water | 2.0 |

The components of the above formula are mixed together and further processed in a manner like that described in Example 1, without evaporation of moisture. When poured into molds and solidified the elastic detergent articles resulting are of the same general desirable properties mentioned for the products of Example 1 but are slightly softer, due to the use of the 225 g. Bloom gelatin. When the moisture content of the final bar is decreased to about 20% by evaporation of water during the manufacturing process, in the manner described in Example 1, the product resulting is firmer and has the other previously described useful properties of such lower moisture content bars. Such firmer products are also made by including 1.5% of alum and 1% of urea in the formulation in replacement of the 2% of water and 0.5% of the pyrogenic silica. When 225 g. Bloom type B gelatin is substituted for the 225 g. Bloom Type A gelatin of this example a useful elastic detergent bar of improved elevated temperature stability also results, which is also the case when 300 g. Bloom Type B gelatin is employed. However, because the pH of the wash water from the present products is on the alkaline side, being about 9, a more stable bar is obtained when the Type A gelatin is used.

In further variations of the above experiments Miranol S2M and SHD Conc. are substituted for the triethanolamine salt of Miranol C2M and acceptable elastic detergent bars of improved elevated temperature stability are also obtained, which is also the case when instead of the Miranols various Deriphats, such as Deriphats 151, 151-C, 154, 160, 160-C and 170-C are employed, preferably in about 50:50 mixtures with such a Miranol salt. Good products result when the ratio of anionic detergent content to amphoteric detergent content is within the range of 2:1 to 1:3. This is also true when the others of the anionic detergents previously mentioned are substituted for the anionic detergents of the examples. The products resulting all have densities within the 0.5 to 0.98 range and such densities are controlled by beating or sparging in more or less air so as to be 0.6, 0.7, 0.8 and 0.9, in separate experiments. Normally, for good dissolving powers and reasonable firmness of the bar the density will be held at about 0.8 or 0.9 g./cc.

The invention has been described wih respect to various embodiments and illustrations thereof but is not to be limited to these because it is evident that one of skill in the art with the present specification before him will be able to utilize substitutes and equivalents without departing from the spirit of the invention.

What is claimed is:

1. A hand squeezable, elastic, solid molded detergent product of improved elevated temperature stability on storage consisting essentially of about 20 to 80% of a mixture of anionic and amphoteric synthetic organic detergents in a proportion between about 1:5 and 5:1, about 5 to 30% of gelatin, about 5 to 50% of water and sufficient gas in small bubbles distributed throughout such product so that the density thereof is in the range of 0.5 to 0.98 g./cc., said anionic synthetic organic detergent being selected from the group consisting of lower alkanolamine higher fatty alcohol sulfates, ammonium higher fatty acid monoglyceride sulfates and mixtures thereof and the amphoteric synthetic organic detergent being selected from the group consisting of imidazolinium betaines, iminodipropionates and aminopropionates and mixtures thereof, which product is sufficiently squeezable and elastic so that a 2 cm. thickness thereof can be pressed between the thumb and forefinger to a 1 cm. thickness and upon release of such pressure will return within five seconds to within 1 mm. of the 2 cm. thickness.

2. An elastic detergent product according to claim 1 wherein the proportion of anionic synthetic organic detergent to amphoteric synthetic organic detergent is in the range of 1:3 to 3:1 and the gelatin is a Type A gelatin of 100 to 300 g. Bloom.

3. An elastic detergent product according to claim 2 wherein the mixture of anionic and amphoteric synthetic organic detergents is from 30 to 70% of the product, the gelatin is of 200 to 300 g. Bloom and is from 7 to 25% and the moisture content is from 5 to 40%.

4. An elastic detergent product according to claim 3 comprising 3 to 20% of lower dihydric or polyhydric alcohol.

5. An elastic detergent product according to claim 4 comprising 0.2 to 2% of lower alkylene glycol di-higher fatty acid ester, 1 to 5% of fumed silica and 0.5 to 4% of a phosphate selected from the group consisting of mono-alkali metal phosphates and di-alkali metal phosphates and mixtures thereof and which is of a density of 0.65 to 0.9 g./cc.

6. An elastic detergent product according to claim 5 wherein the anionic synthetic organic detergent is triethanolammonium lauryl sulfate, the amphoteric detergent is triethanolammonium 1-carboxymethyl-1-carboxyethoxyethyl-2-coco-imidazolinium betaine, the proportion thereof is from 1:2 to 1:1 and the gas is air.

7. An elastic detergent product according to claim 5 wherein the anionic synthetic organic detergent is a mixture of triethanolammonium lauryl sulfate and ammonium coco-monoglyceride sulfate in a proportion within the range of 1:2 to 2:1 and the amphoteric synthetic organic detergent is triethanolammonium 1-carboxymethyl-1-carboxyethoxyethyl-2-coco-imidazolinium betaine, the proportion of total anionic synthetic organic detergent to amphoteric detergent being in the range of 1:2 to 1:1 and the gas is air.

8. An elastic detergent product according to claim 6 comprising about 19% of triethanolammonium lauryl sulfate, about 28% of triethanolammonium 1-carboxymethyl-1-carboxyethoxyethyl-2-coco-imidazolinium betaine, about 10% of 300 g. Bloom type A gelatin, about 10% of propylene glycol, about 3% of fumed silica, about 0.5% of ethylene glycol distearate, about 0.3% of monosodium phosphate, about 0.7% of disodium phosphate and about 28.5% of water.

9. An elastic detergent product according to claim 7 comprising about 9.5% of triethanolammonium lauryl sulfate, about 11% of ammonium coco-monoglyceride sulfate, about 28% of triethanolammonium 1-carboxymethyl-1-carboxyethoxyethyl-2-coco-imidazolinium betaine, about 10% of 300 g. Bloom type A gelatin, about 10% of propylene glycol, about 3% of fumed silica, about 0.5% of ethylene glycol distearate, about 0.3% of monosodium phosphate, about 0.7% of disodium phosphate and about 27% of water.

10. An elastic detergent product according to claim 6 comprising about 21.1% of triethanolammonium lauryl sulfate, about 31.1% of triethanolammonium 1-carboxymethyl-1-carboxyethoxyethyl-2-coco-imidazolinium betaine, about 11.1% of 300 g. Bloom type A gelatin, about 11.1% of propylene glycol, about 3.3% of fumed silica, about 0.6% of ethylene glycol distearate, about 0.3% of monosodium phosphate, about 0.8% of disodium phosphate and about 20.6% of water.

11. An elastic detergent product according to claim 7 comprising about 10.6% of triethanolammonium lauryl sulfate, about 12.2% of ammonium coco-monoglyceride sulfate, about 31.1% of triethanolammonium 1-carboxymethyl-1-carboxyethoxyethyl-2-coco-imidazolinium betaine, about 11.1% of 300 g. Bloom type A gelatin, about 11.1% of propylene glycol, about 3.3% of fumed silica, about 0.6% of ethylene glycol distearate, about 0.3% of monosodium phosphate, about 0.8% of disodium phosphate and about 18.9% of water.

12. An elastic detergent product according to claim 1 comprising about 0.2 to 5% of a lower alkylene glycol di-higher fatty acid ester wherein the higher fatty acid is of 10 to 20 carbon atoms.

13. An elastic detergent product according to claim 12 wherein the lower alkylene glycol di-higher fatty acid ester is ethylene glycol distearate, 0.2 to 2% of which is present, and the detergent product comprises 1 to 5% of fumed silica and 0.5 to 4% of a phosphate selected from the group consisting of monosodium phosphate and disodium phosphate and mixtures thereof.

14. A hand squeezable, elastic, solid molded detergent product of improved elevated temperature stability on storage which consists essentially of an amphoteric detergent selected from the group consisting of imidazolinium betaines, iminodipropionates and aminopropionates and mixtures thereof, solvent and gelatin, with a gas distributed through said product in small bubbles so that the density of the product is in the range of 0.5 to 0.98 g./cc., which product is sufficiently squeezable and elastic so that a 2 cm. thickness thereof can be pressed between a thumb and forefinger to a 1 cm. thickness and upon release of such pressure will return within five seconds to within 1 mm. of the 2 cm. thickness.

15. An elastic detergent product according to claim 14 wherein the amphoteric detergent is selected from the group consisting of imidazolinium betaines, betaaminopropionates and betaiminodipropionates and mixtures thereof.

16. An elastic detergent product according to claim 15 wherein the amphoteric synthetic organic detergent is triethanolammonium 1-carboxymethyl-1-carboxyethoxyethyl-2-coco-imidazolinium betaine.

17. A method of making a hand squeezable, elastic, solid molded detergent product of improved elevated temperature stability on storage, which product comprises about 20 to 80% of a mixture of anionic and amphoteric synthetic organic detergents in a proportion between about 1:5 and 5:1, about 5 to 30% of gelatin, about 5 to 50% of water and sufficient gas in small bubbles distributed throughout the product so that the density thereof is in the range of 0.5 to 0.98 g./cc., which product is sufficiently squeezable and elastic so that a 2 cm. thickness thereof can be pressed between the thumb and forefinger to a 1 cm. thickness and upon release of such pressure will return within five seconds to within 1 mm. of the 2 cm. thickness and in which product the anionic synthetic organic detergent is selected from the group consisting of ammonium higher fatty monoglyceride sulfates and lower alkanolammonium higher fatty alcohol sulfates and mixtures thereof and the amphoteric detergent is selected from the group consisting of imidazolinium betaines, iminodipropionates and aminopropionates and mixtures thereof, which comprises mixing the detergents, gelatin and water together at an elevated temperature to dissolve the gelatin therein, mixing in insoluble gas therewith to produce small bubbles thereof throughout the mixture, so as to increase the volume thereof from about 5 to 60% and cooling the mix to solidify it and entrap the gas bubbles therein.

18. A method according to claim 17 wherein the amphoteric synthetic organic detergent is selected from the group consisting of imidazolinium betaines, betaiminodipropionates and betaaminopropionates and mixtures thereof, the proportion of anionic synthetic organic detergent to amphoteric synthetic organic detergent is in the range of 1:3 to 3:1, the gelatin is a Type A gelatin of 200 to 300 g. Bloom, the mixture of anionic and amphoteric synthetic organic detergents is from 30 to 70% of the product, the gelatin content of the product is from 7 to 25% and the moisture content is from 5 to 40% and which method comprises mixing the detergents, gelatin and water at a temperature in the range of about 50° to 90° C. to dissolve the gelatin therein, cooling the mix to a temperature in the range of 30° to 45° C., mixing air therewith to produce small air bubbles throughout the mixture, so as to increase the volume thereof from about 10 to 50% and cooling the mix to a temperature in the range of 10° to 25° C. to solidify it and entrap the air bubbles therein.

19. A method according to claim 18 wherein the mixture of anionic and amphoteric synthetic organic detergents, gelatin, and water, containing about 15 to 40% of water, also includes 3 to 20% of lower dihydric or polyhydric alcohol and before cooling and mixing therein of air, it is heated long enough, with or without vacuum treatment, to remove at least 7% of the mix of water, so that the final product contains 5 to 30% of water, after which the mix is cooled to solidify it and to entrap the gas bubbles therein, said cooling being effected in a mold in which the elastic detergent product is molded to shape.

* * * * *